US007937871B2

(12) United States Patent
Mantas

(10) Patent No.: US 7,937,871 B2
(45) Date of Patent: May 10, 2011

(54) FLOORPLATE FOR HANDGUN MAGAZINES FOR THE BREAKAGE OF GLASS PANES

(76) Inventor: Dimitrios Mantas, Athens (GR)

( * ) Notice: Subject to any disclaimer, the term of this patent is extended or adjusted under 35 U.S.C. 154(b) by 197 days.

(21) Appl. No.: 12/522,325

(22) PCT Filed: May 15, 2008

(86) PCT No.: PCT/GR2008/000038

§ 371 (c)(1),
(2), (4) Date: Jul. 7, 2009

(87) PCT Pub. No.: WO2008/139233

PCT Pub. Date: Nov. 20, 2008

(65) Prior Publication Data

US 2010/0043270 A1 Feb. 25, 2010

(30) Foreign Application Priority Data

May 16, 2007 (GR) ..... 070100295

(51) Int. Cl.
*F41A 9/61* (2006.01)

(52) U.S. Cl. ..... 42/49.01; 42/50; 42/90; 42/106; 225/103

(58) Field of Classification Search ..... 42/49.01, 42/50, 90, 106; 89/33.1; 225/103
See application file for complete search history.

(56) References Cited

U.S. PATENT DOCUMENTS

| | | | | |
|---|---|---|---|---|
| 6,666,566 | B1 * | 12/2003 | Uke | 362/202 |
| 6,883,261 | B2 * | 4/2005 | Fitzpatrick | 42/50 |
| 7,743,542 | B1 * | 6/2010 | Novak | 42/7 |
| 2004/0159033 | A1 * | 8/2004 | Rohrbaugh | 42/69.03 |
| 2005/0082331 | A1 * | 4/2005 | Yang | 225/2 |
| 2008/0222895 | A1 * | 9/2008 | Marfione et al. | 30/151 |

* cited by examiner

*Primary Examiner* — J. Woodrow Eldred
(74) *Attorney, Agent, or Firm* — Notaro, Michalos & Zaccaria P.C.

(57) ABSTRACT

A floorplate for a handgun magazine is used for the breakage of glass panes and is manufactured so that it fits all types of handgun magazines without disrupting the overall function of either the magazine or the handgun. The floorplate has a hole in which a pin is incorporated. The floorplate, when placed on the magazine of the handgun, allows the magazine to be also used as a hand tool for the breakage of glass panes. Additionally, when the magazine with the floorplate and incorporated pin is placed inside the handgun, it allows the handgun to be also used as a hammer-like tool for the breakage of glass panes.

4 Claims, 2 Drawing Sheets

FLOORPLATE FOR HANDGUN MAGAZINES FOR THE BREAKAGE OF GLASS PANES

BACKGROUND OF THE INVENTION

The invention refers to a floorplate of handgun magazines that includes an incorporated pin, with the purpose of being placed on the magazine to enable it to be also used as a tool for the breakage of glass panes, and with the aim to manufacture this floorplate so as to be placed on all types of handgun magazines.

The considerable volume of weaponry and equipment that is carried by police officers during the discharge of their duty, such as handgun, magazines, torch or flashlight, club, handcuffs, radio, electroshock handgun and their corresponding cases and holsters, prevents them from carrying an additional tool for the breakage of glass panes. It is noted that such a tool is essential either for prompt intervention for the enforcement of law, or for the release of trapped persons.

Many times, the doors and windows of vehicles cannot be opened and the passengers get trapped either after a collision of vehicles where there is deformation of the car body or possibly fire, or in the case of a vehicle immersion in water, where there is water pressure and a breakdown of electric circuits in the vehicle.

The advantages of the invention described here are that, if a floorplate with an incorporated pin whose one end is cone-shaped is placed on a handgun magazine, that magazine, as well as the handgun, can be used as tools for the breakage of glass panes, and consequently the expense for the purchase of a separate tool for this purpose is saved, the addition of another piece of equipment carried by police officers on duty is avoided, while the handgun and the extra magazines are always carried separately in different cases and holsters for direct access.

BACKGROUND ART

The existing technology regarding handgun magazines includes floorplates which replace the original floorplate that the magazine was constructed with, and either offer a greater storage capacity of bullets in the magazine, as in US Patent Publication Number US2002/029506, or extend the stock length so as to offer a steadier grip to the shooter, as in US Patent Publication Number US2005/011097, or floorplates that have a socket for the handgun and which offer the possibility for the magazine to accept additional accessories (flashlight or laser beam), as in US Patent Publication Number US2003/0374747.

SUMMARY OF THE INVENTION

The invention that will be described refers to a floorplate (F) with an incorporated pin (P) and is distinguished by the fact that if the original floorplate that a magazine was constructed with is replaced by the floorplate (F) with the incorporated pin (P), the magazine itself can be used also as a tool for the breakage of glass panes, without disrupting the overall function of the magazine. Consequently, when a handgun (W) contains a magazine (M) where the floorplate (F) with the incorporated pin (P) is used, the handgun (W) itself can also be used as a hammer-like tool for the breakage of glass panes.

DESCRIPTION OF THE PREFERRED EMBODIMENT

Figure 1:
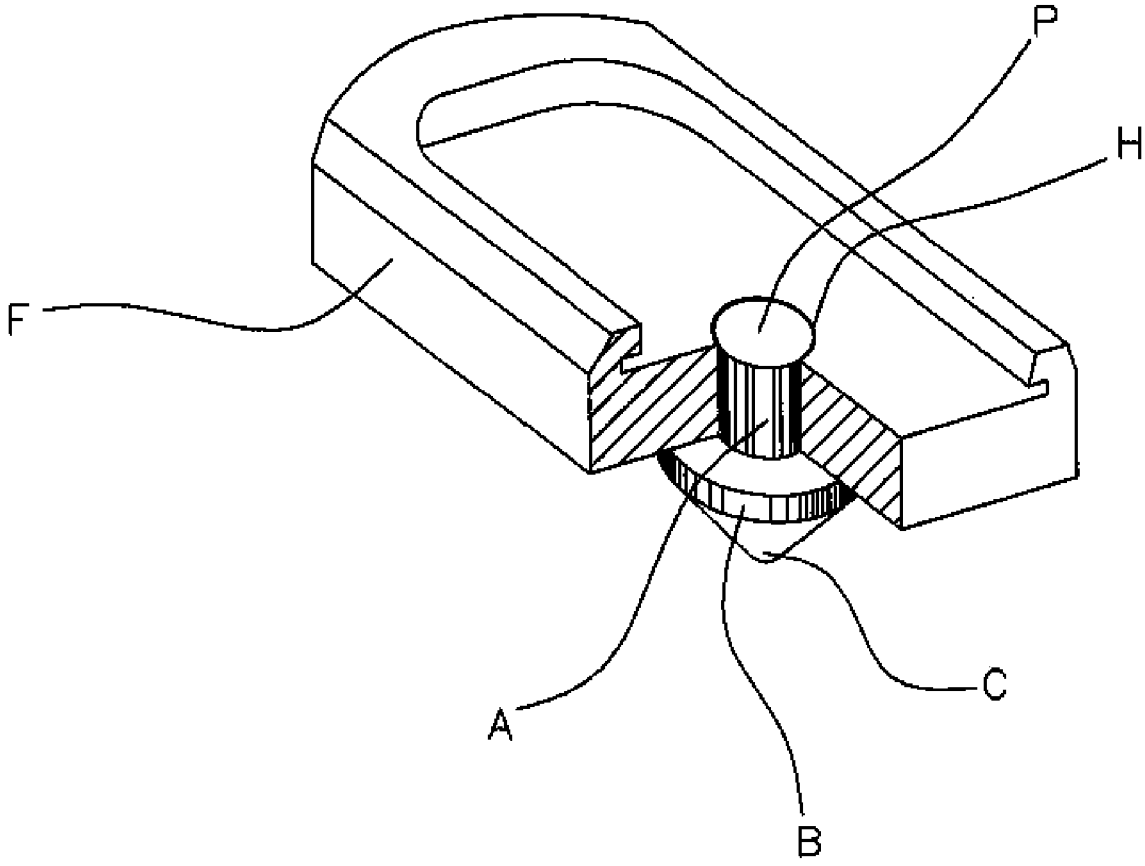
FIG. 1 is a perspective view of a magazine floorplate of the present invention, with a portion cut away.

In FIG. 1 a floorplate F of the magazine of a handgun, has a pinhole H, that is to say, a hole for a pin to be described later. A pin P which has an inner end A with a smaller diameter, extends and is incorporated or fixed into the pinhole H. An opposite outer end B of the pin P has a larger diameter portion compared to the diameter of inner end A so as to prevent the pin P from entering further into the pinhole H of the floorplate F while at the same time a tip or end portion C of the end B of the pin P is cone-shaped and pointed at an end of pin P that is opposite from the small diameter end A, in order to enable the smashing of glass panes when the pointed tip of end portion C, which tapers from the larger diameter portion of the outer end B, strikes the glass plane. Floorplate F has an inner surface that faces the interior of the magazine M which is visible in FIG. 1, and an outer surface that is opposite from the inner surface and from which the outer end B of pin P extends. The pin P is made of metal of adequate hardness for the breakage of glass.

The separate formation of the pinhole H can be omitted for the floorplate F, and the incorporation of the pin P can be realized during the construction of the floorplate (F), that is, during a casting phase for the floorplate. To this end the pin P is placed inside a floorplate mold for casting the floorplate, and the mold is supplied by a casting machine with plastic under pressure and thus the pin P is incorporated in the material of the floorplate F automatically.

Figure 2:
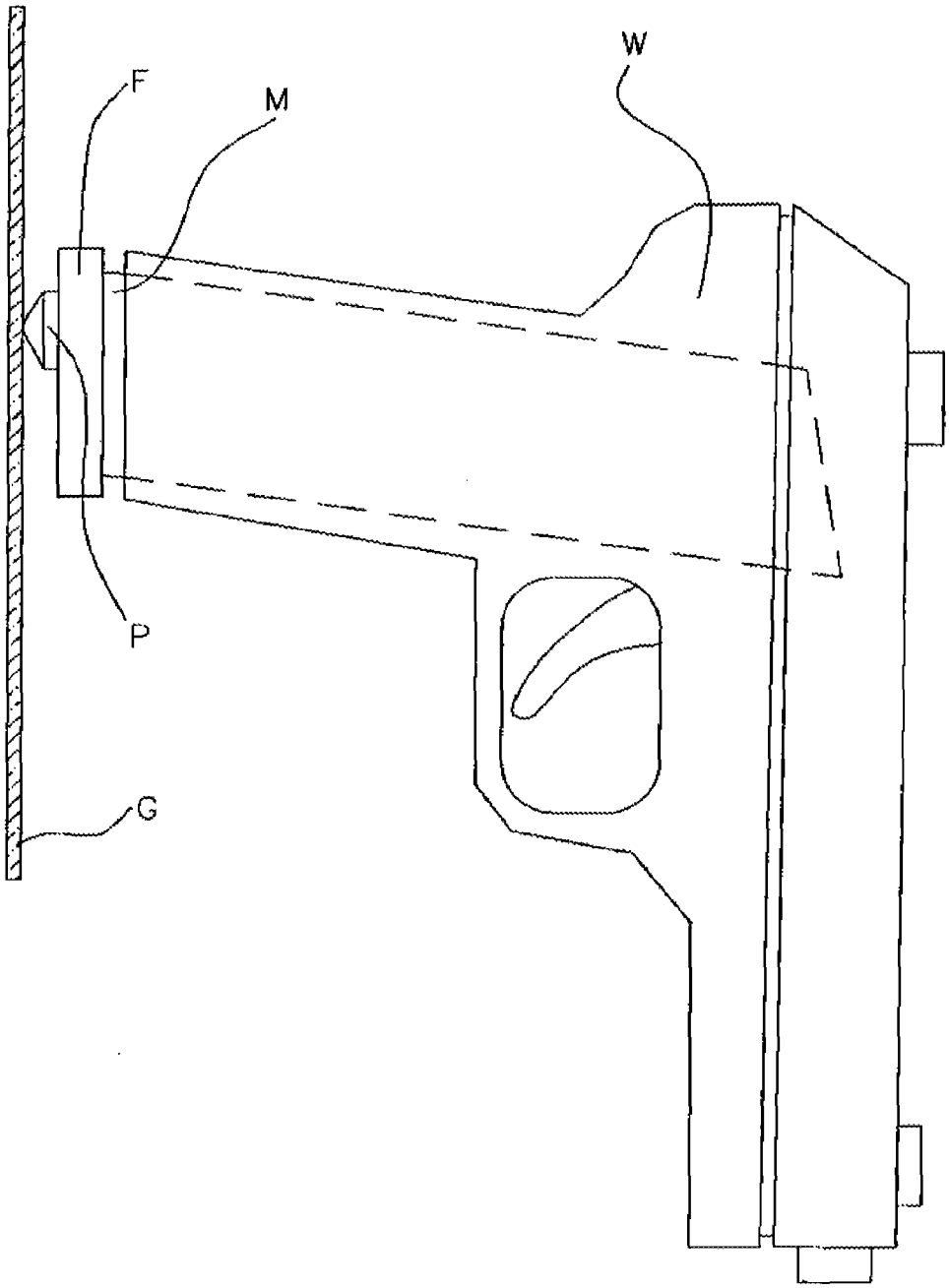
FIG. 2 is a side elevational view of a handgun with a magazine with floorplate according to the present invention.

In FIG. 2 a handgun W with a magazine M loaded therein are presented. The magazine M bears the floorplate F with the incorporated pin P where in this case the handgun W can also be used as a hammer-like tool for the breakage of a glass pane G. Also, the magazine M itself, which bears the floorplate (F) with the incorporated pin P, can be used independently from the handgun W for the breakage of glass panes G.

The replacement of the original floorplate at the magazine M by the floorplate F, which bears the pin P, does not change the overall function of the magazine M or consequently of the handgun W using that magazine.

For reasons of safety, the handgun W must have no bullet in its chamber when it is used as a tool for the breakage of glass panes G.

The invention claimed is:

1. A floorplate arrangement for a handgun magazine for fitting a selected handgun and for breakage of glass panes, the floorplate arrangement comprising:

a floorplate (F) having an inner surface, an opposite outer surface, and a hole (H); a pin (P) fixed to the floorplate (F), said floorplate (F) being adapted to function with the handgun magazine of the selected handgun; said pin (P) having an inner end (A) and an outer end (B), said inner end (A) having a smaller diameter than a larger diameter portion of said outer end (B), said inner end (A) being fixed in said hole (H) of said floorplate (F); said outer end (B) of said pin (P) extending from the outer surface of said floor plate with the larger diameter portion of the outer end (B) engaging the outer surface of the floor plate so that said pin (P) cannot enter further into said hole (H) of said floorplate (F); and said outer end (B) of said pin (P) further comprising a cone (C) tapering in a direction away from the outer surface of the floorplate (F).

2. In a handgun having a magazine with a floorplate, the improvement comprising: the floorplate (F) having an inner surface, an opposite outer surface, and a hole (H); a pin (P) fixed to the floorplate (F), said pin (P) having an inner end (A) and an outer end (B), said inner end (A) having a smaller diameter than a larger diameter portion of said outer end (B), said inner end (A) being fixed in said hole (H) of said floorplate (F); said outer end (B) of said pin (P) extending from the outer surface of said floor plate with the larger diameter portion of the outer end (B) engaging the outer surface of the floor plate so that said pin (P) cannot enter further into said hole (H) of said floorplate (F); and said outer end (B) of said pin (P) further comprising a pointed cone (C) tapering in a direction away from the outer surface of the floorplate (F) so that when the magazine with said floorplate in engaged in the handgun, the handgun is used like a hammer to strike a glass pane with the pointed cone (C) to break the glass pane.

3. A floorplate arrangement according to claim 1, wherein the cone (C) is pointed for breaking a glass pane and the pin (P) is made of metal.

4. A floorplate arrangement according to claim 2, wherein the cone (C) is pointed for breaking a glass pane and the pin (P) is made of metal.

* * * * *